United States Patent [19]

Gruener

[11] 4,249,478

[45] Feb. 10, 1981

[54] CONTROLLER FOR CURTAIN COATER

[76] Inventor: Rolf Gruener, 7 Shangri La., Wallingford, Conn. 06492

[21] Appl. No.: 23,468

[22] Filed: Mar. 23, 1979

[51] Int. Cl.[3] ..... B05C 5/00

[52] U.S. Cl. ..... 118/668; 118/DIG. 4; 118/683; 118/324

[58] Field of Search ..... 427/420; 118/DIG. 4, 118/668, 324, 683

[56] References Cited

U.S. PATENT DOCUMENTS

| | | | |
|---|---|---|---|
| 4,060,649 | 11/1977 | Coleman | 427/420 |
| 4,075,976 | 2/1978 | Clayton | 427/420 |

*Primary Examiner*—Sam Silverberg

*Attorney, Agent, or Firm*—McCormick, Paulding, & Huber

[57] ABSTRACT

A controller for maintaining a constant thickness of a layer applied to work pieces fed through a liquified curtain, the curtain itself being provided through a positive displacement pump which is driven by a motor having means for varying its speed from a remote locate. The work pieces are fed by an infeed conveyor, which is also driven by a motor of the variable speed type, and magnetic pickups or sensors are provided to produce two discrete trains of pulses indicative of the speed of the infeed conveyor, and of the positive displacement pump respectively. A digital readout ratio calculating unit is provided to produce a display indicative of the ratio of these pulse train frequencies, and the unit can be preset to provide an input to low and high limit preset counters. The preset low and the high preset counts are electrically connected to relays, which control the speed of the pump motor itself through conventional circuitry, and the resulting controller provides for continuously updating the speed of the pump motor to maintain a predetermined ratio of its speed to that of the infeed conveyor for maintaining a predetermined coating thickness on the work piece.

1 Claim, 2 Drawing Figures

CONTROLLER FOR CURTAIN COATER

SUMMARY OF THE INVENTION

This invention relates generally to machines for coating work pieces with a curtain of liquified material and deals more particularly with a cutain coater having means for automatically controlling the thickness of the coating layer applied to the upper surface of the work piece as it passes through a curtain created by conventional means, including a positive displacement pump in conjunction with any elongated aperture defining a cross sectional area such that the volume rate of flow of the coating material is directly related to the speed of the pump motor.

Such a curtain coating machine is generally provided with conveyor means for the work pieces to be fed at a speed which can be varied, and as a result of varying the infeed speed of the work pieces the thickness of the coating will be varied if the pump motor is maintained at a constant speed. The present invention seeks to provide means for continuously controlling the speed of the pump motor in order to assure that the ratio of pump speed to conveyor speed remains within predetermined limits.

This result is achieved with the use of conventional components combined in a unique combination such that a preset ratio display unit is used in conjunction with preset limit switches of the thumbwheel type in order to provide a control for the relays associated with the remotely controllable pump motor in order to increase or decrease its speed so as to match the speed of the positive displacement pump with that of the infeed conveyor passing work pieces through the curtain.

DETAILED DESCRIPTION

Figure 1:
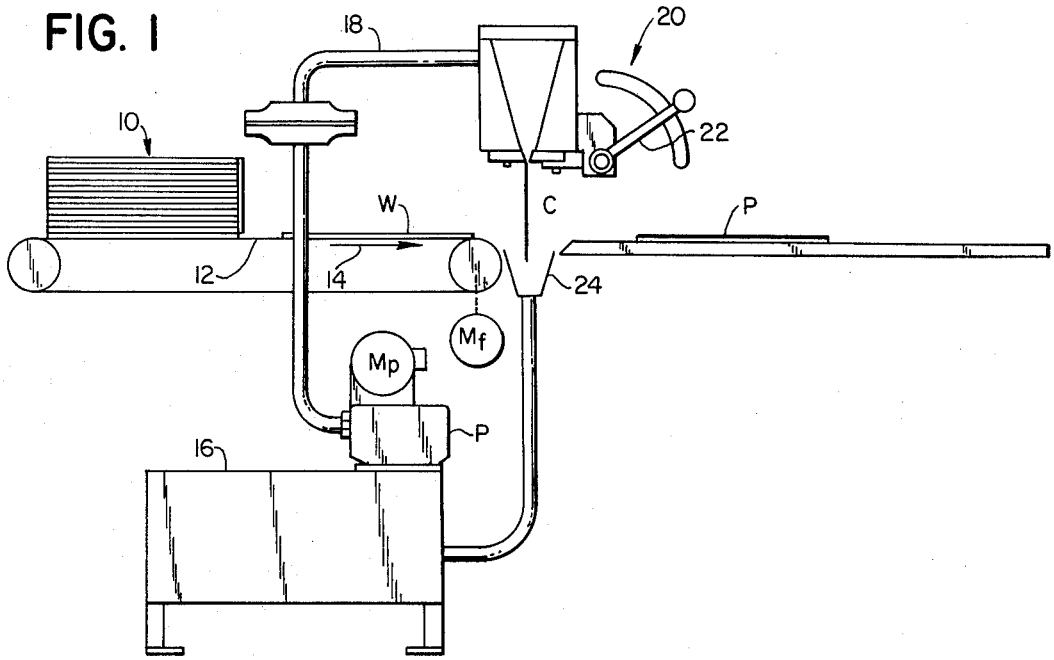
FIG. 1 is a schematic view illustrating in elevation the components of a typical curtain coater of the type which is most advantageously equipped with a controller of the present invention.

Turning now to the drawing in greater detail, FIG. 1 shows a stack of work pieces at 10 provided on an infeed conveyor 12 continuously driven in the direction of the arrow 14 by feed motor Mf such that the lowermost work piece in the stack is fed in the direction of the arrow 14 as shown generally at W in FIG. 1. The work piece may comprise a cardboard panel to be coated with liquid wax, or may comprise some other generally flat work piece to be coated to a desired thickness with some sort of coating material adapted to be provided in liquid form, as a curtain such as shown at C, through which liquid curtain the work piece W can be fed in order to produce the coated product, as indicated generally at P in FIG. 1.

The liquid from which the curtain C is created is stored in a tank 16 such that a pump P is adapted to draw the liquid from the tank 16, and to feed the liquid through the pipe 18 into the coating head 20. The coating head 20 is of conventional construction, being laterally elongated so as to define an orifice at the bottom portion thereof through which the liquid is adapted to pass by gravity in forming the curtain C mentioned previously. An orifice plate is precision ground and controls the flow of coating material in order to create the desired thickness of the coating best suited for the viscosity and other characteristics of the liquid material itself. A control lever is preferably connected to the movable portion of the orifice plate in accordance with conventional practice to permit slight variations to be made to the geometry of the curtain C. It should be noted that this adjustment once made will not be varied for a particular type of material to be coated, and that the chief variables in the apparatus just described will generally consist of the variable speed drive associated with the infeed conveyor motor Mf, and the remotely controlled drive for the pump motor Mp which rotates the constant displacement pump P. Thus, the two chief variables provided for altering the thickness of the coating on the product P will be the speed of the infeed conveyor motor Mf, and the angular speed of rotation of the pump P (or of the pump motor Mp).

Figure 2:
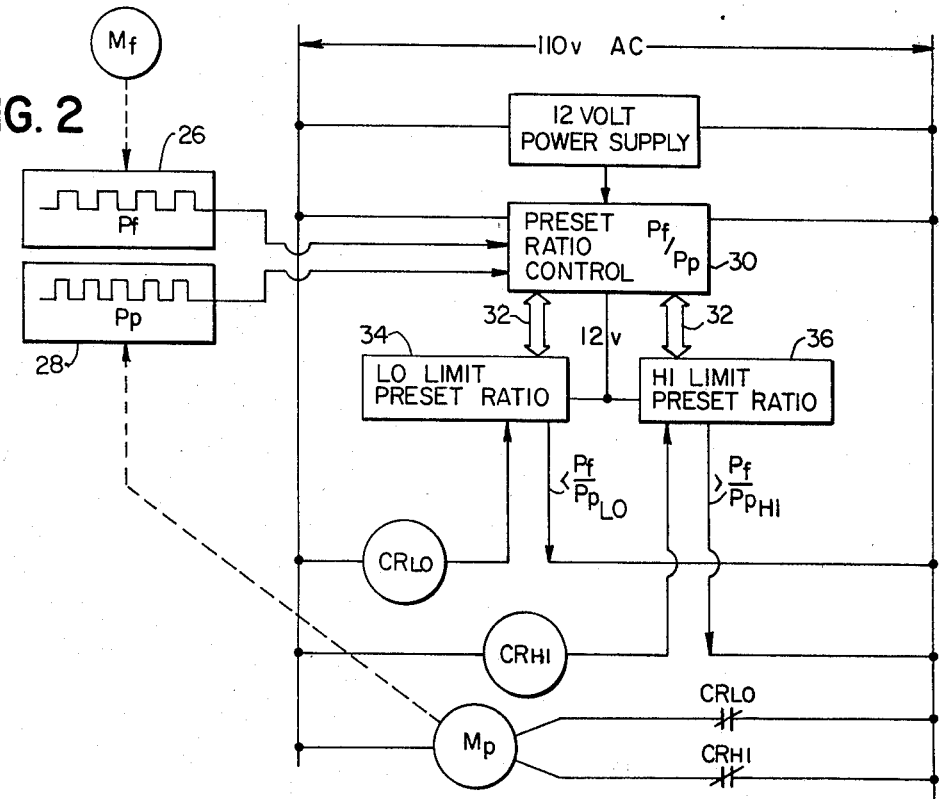
FIG. 2 is a schematic view of a controller constructed in accordance with the present invention and illustrates the positive displacement pump motor and the motor for driving the infeed conveyor as illustrated in FIG. 1.

Thus, the curtain C is created by means of the components mentioned above, and in order to provide for a continuous curtain C for coating the work pieces W feed intermittently through the curtain, a return trough 24 is provided to return material to the tank 16 when no work piece is in the process of being coated, as suggested in FIG. 1. Once the lever 22 is set for a predetermined curtain material as mentioned above it will be apparent that varying the speed of the infeed conveyor motor Mf will result in changes to the thickness of the coating provided on the work piece P and it is an important feature of the present invention that this variation to the speed of the infeed conveyor be made to have little or no effect upon the thickness of the coating applied to the product P. FIG. 2 shows in detail my presently preferred system for controlling the speed of the pump motor Mp in order to maintain the thickness of the coating on the product P within predetermined limits in spite of variations made to the speed of the infeed conveyor Mf.

As suggested in FIG. 2 a magnetic pickup or sensor is provided in association with a sprocket (not shown) on one sprocket of the infeed conveyor (or associated directly with the angular speed of rotation of the motor Mf as suggested at 26 in FIG. 2) in order to provide a series or train of electrical pulses porportional in frequency to the speed of this infeed conveyor and hence of the work pieces W fed therealong. A similar magnetic pickup or sensor is provided in association with the pump P, or its motor Mp, in order to provide a continuous series or train of pulses Pp proportional in frequency to the speed of rotation of the constant displacement pump P. These sensors are of conventional configuration and each preferably comprises a sprocket of magnetically sensitive material with a predetermined number of teeth so as to provide the desired number of pulses relative to a single revolution of the shaft to which it is attached, and an electrically activated magnetic sensor to provide the desired electrical pulse train to the preset ratio control device 30 shown in FIG. 2.

The device 30 preferably comprises a Digital Ratio Indicator having a digital readout to display the instantaneous ratio between the pulse trains Pf and Pp in digitial form. Such a device is made under Model 621 by Red Lion Controls of York, Pa., and is available with manual selector means for preseting a predetermined ratio at the rear of such a device in order to provide a binary coded decimal data output signal, in the bus 32, indicative of the difference between the instantaneous pulse ratio as calculated by the device 30 and the ratio preset at the rear of the device as mentioned.

This data, or count differential information in binary coded decimal form, is fed to two conventional preset thumbwheel switch type counters 34 and 36, which counters are preset, to preselected high and low limit counts respectively, associated with the desired or predetermined ratio in the unit 30 in order to produce an output in the lines as indicated by the less than Pf over Pp LO, and the greater than Pf over Pp HI notations respectively. The output from the preset counters 34 and 36 is thus caused selectively to energize one or the other of the relays CR LO and CR HI accordingly as the actual ratio calculated by the device 30 is found to be above or below the predetermined limits said in the counters 34 and 36.

The relays CR LO and CR HI are conventionally connected to the control circuitry associated with the pump motor Mp. This motor control preferably comprises a Reeves Motodrive electric remote control device of the type sold by Reliance Electric Company of Columbus, Ind. under Model 1-62943. The remote control capability of this unit lends itself well to being controlled by the circuitry of FIG. 2. The speed of conveyor motor Mf need not be electrically controlled remotely, but is controllable manually. This invention allows changes to the speed of the infeed conveyor to be made without adversely affecting the thickness of the coating layer applied to the product P.

I claim:

1. In a machine for feeding flat work pieces through a liquified curtain for coating the upper surfaces with a layer of coating material, the thickness of which layer is proportional to the speed at which the work pieces are fed through the curtain and the volume rate of flow for the liquified curtain, said machine including means for varying the speed of an infeed conveyor for the work pieces and a positive displacement pump driven by a variable speed remotely controllable motor to provide the liquid flow rate for the curtain, the improvement comprising:

(a) means for producing a first series of electrical pulses (Pf) proportional in frequency to the speed of the infeed conveyor, (b) means for producing a second series of electrical pulses (Pp) proportional in frequency to the angular speed of rotation of said positive displacement pump, (c) electronic ratio means for calculating the numerical ratio (Pf/Pp) between said first and second electrical pulse frequencies and producing discrete digital output signals indicative of the instantaneous condition of said numerical ratio as greater than or less than a predetermined ratio preset in said ratio means, (d) low and high preset counter modules coupled to said electronic ratio means to provide discrete outputs when said instantaneous count exceeds low and high predetermined limits preset therein, and (e) means for varying the angular speed of rotation of said pump in response to said discrete low and high preset ratio limits, whereby the thickness of said coating is continuously kept in a predetermined range in spite of variations made to the speed of work pieces on the infeed conveyor.

* * * * *